US006887169B2

(12) United States Patent
Whitehill et al.

(10) Patent No.: US 6,887,169 B2
(45) Date of Patent: May 3, 2005

(54) GOLF TEE SETTER

(76) Inventors: Charles R. Whitehill, 10851 NW. 50$^{th}$ St., Sunrise, FL (US) 33501; John L. Bell, 2600 Timber Cove, Annapolis, MD (US) 21401

( * ) Notice: Subject to any disclaimer, the term of this patent is extended or adjusted under 35 U.S.C. 154(b) by 0 days.

(21) Appl. No.: 10/636,880

(22) Filed: Aug. 7, 2003

(65) Prior Publication Data

US 2004/0029653 A1 Feb. 12, 2004

Related U.S. Application Data

(60) Provisional application No. 60/402,200, filed on Aug. 8, 2002.

(51) Int. Cl.[7] ..... A63B 57/00
(52) U.S. Cl. ..... 473/386
(58) Field of Search ..... 473/386, 133, 473/286; 294/19.1, 19.2

(56) References Cited

U.S. PATENT DOCUMENTS 3,904,200 A * 9/1975 Jackle et al. ..... 473/386
5,494,279 A * 2/1996 Ahner ..... 473/386
6,254,497 B1 * 7/2001 Brant et al. ..... 473/386
6,338,685 B1 * 1/2002 Posluszny ..... 473/386
6,394,515 B1 * 5/2002 Keleher et al. ..... 294/19.2

* cited by examiner

*Primary Examiner*—Steven Wong
(74) *Attorney, Agent, or Firm*—Law Offices of Royal W. Craig

(57) ABSTRACT

A tee setting device for single-handed setting of a golf ball and tee in the ground at any one of a variety of selected insertion depths, while also adjusting for a range of different tee lengths. The device generally comprises a hollow shaft having a knob and an operating handle at an upper end, a stand-up leg assembly at the lower end, and a tee-setting mechanism at the lower end for controlled insertion and release of a ball and tee in the ground. The tee and ball are inserted simply by gripping the operating handle and pushing it downward. The tee setting device allows golfers to automatically set the ball and tee in the ground, thereby avoiding squatting or bending over the ball. The device is extremely accurate and consistent in setting the height of the ball on tees of various lengths. Moreover, the tee setting device is sized like a playing club or iron, and can be easily manipulated and stowed in the golf bag.

18 Claims, 6 Drawing Sheets

GOLF TEE SETTER

CROSS-REFERENCE TO RELATED APPLICATIONS

The present application derives priority from U.S. provisional application No. 60/402,200 filed: Aug. 8, 2002.

BACKGROUND OF THE INVENTION

1. Field of the Invention

The present invention relates to golf accessories, and more precisely, to a device for implanting a golf tee and ball in the ground without bending over.

2. Description of the Background

Many golfers have anatomical difficulty with the task of squatting and/or bending over to implant a golf tee in the ground prior to driving the ball. The difficulty may arise from back problems, arthritis, knee problems, etc., and what ever the cause it inevitably detracts from the golfer's enjoyment of the game. Thus, here is a need for a golf accessory capable of avoiding and/or reducing the bending a golfer must endure during the course of a round.

There have been prior efforts to develop automatic tee-setting devices, all of which suffer from an inability to set the height of the tee and ball with great precision and consistency.

For example, U.S. Pat. No. 5,540,432 to Keller shows a tee setting device that plants the tee and then places the ball. Unfortunately, it takes great skill to balance the ball on the planted tee.

U.S. Pat. No. 5,667,222 to Bunyi shows an unwieldy and expensive automatic golf ball tee setter that a golfer cannot use in regulation play.

U.S. Pat. No. 4,949,961 to Milano discloses a more practical tee setting device that can be stored in a golf bag and which automatically leaves the ball on the planted tee. However, the height of the tee is determined solely by insertion force, and this leads to inconsistency.

Accordingly, there remains a commercial need for an accurate and consistent golf ball and tee setting device for golfers that are unable to, or are discomforted by back problems, to help them avoid squatting or bending over the ball while implanting the tee.

SUMMARY OF THE INVENTION

It is, therefore, an object of the present invention to provide a golf ball and tee setting device for golfers to automatically set the ball and tee in the ground, thereby avoiding squatting or bending over the ball.

It is another object to provide a golf ball and tee setting device for golfers as described above that is approximately the same size as a playing club or iron, and which is easily manipulated.

It is another object to provide a golf ball and tee setting device for golfers as described above that is extremely accurate and consistent in setting the height of the ball on the tee.

It is another object to provide a golf ball and tee setting device for golfers as described above that implants a tee at a variety of selectable tee heights, and which adjusts to accomplish the foregoing with a variety of conventional tee lengths.

Still another object of the invention is to provide a provide a golf ball and tee setting device with few moving parts, capable of easy operation, and of long-term use due to its simplified construction.

According to the present invention, the above-described and other objects are accomplished by providing a tee setting device for setting a golf ball and tee in the ground at a selected insertion depth. The device generally comprises a hollow shaft having a fixed handle and an operating handle at an upper end, a stand-up leg assembly at the lower end, and a tee-setting mechanism at the lower end for controlled insertion of a ball and tee in the ground. The tee and ball are inserted simply by gripping the operating handle, and pushing it downward.

The sliding operating handle is carried beneath the fixed or stationery handle on the shaft for ease of operation. The operating handle is coupled to a control rod internal to and extending downward through the shaft so that downward urging of the operating handle works the tee setting mechanism. Specifically, guide screw is threaded through the operating handle, through a control notch in the shaft, and into said control rod. The control notch imparts a specific pattern of rotation and downward movement to the control rod, which in turn works the tee-setting mechanism to insert the ball-on-tee to a choice of predetermined depths. The tee setting mechanism further includes a ball cage assembly attached to a lower end of the shaft for confining and/or releasing the ball and tee, and a ball-cup mounted at the lower distal end of the control rod for insertion of the ball and tee. The ball cage assembly is a pair of opposing ball cage jaws for guiding the ball atop the tee and gripping the tee. The ball cage jaws are in operative engagement with the control rod and are selectively openable by sliding operation of the operating handle to implant and then release the ball and tee. The stand-up leg assembly includes a tripod of steady legs that are pivotally attached above the ball cage assembly and an be automatically unfolded by gravity to a spread position for steadying said ball cage at a controlled height above the ground. The legs can be automatically folded by gravity for placement in the golf bag.

The foregoing device reduces the bending a golfer endures during a round of golf by allowing the golfer to implant a tee in the ground with ball atop without squatting or bending over the ball. While in the teeing area, a golfer need only push and twist the operating handle to select the desired tee height and the ball is ready to play.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
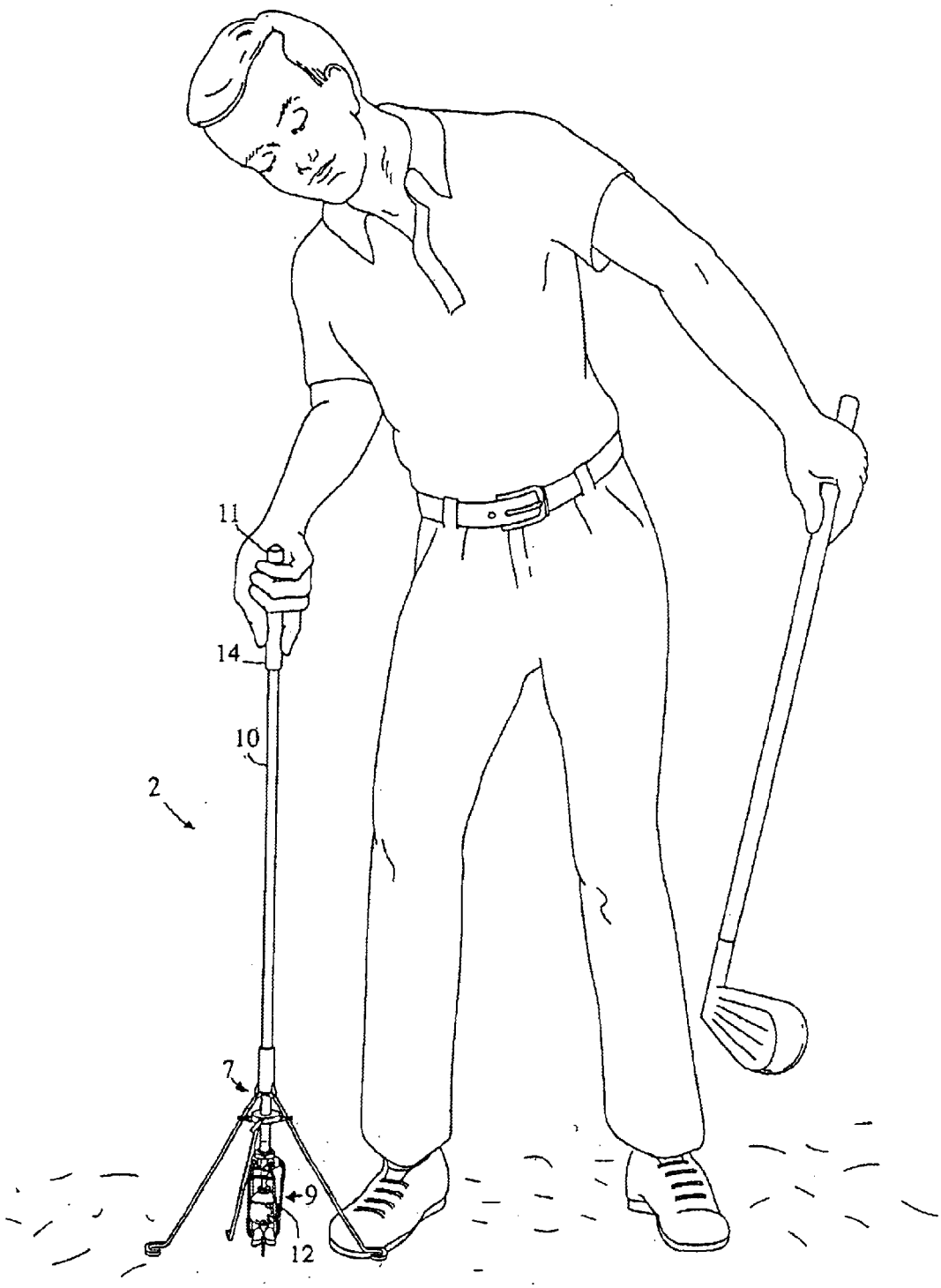
FIG. 1 is a perspective front view of the stand-up tee setter 2 according to a preferred embodiment of the present invention.

FIG. 1 is a perspective front view of the stand-up tee setter 2 according to the present invention. The tee setter 2 is designed for setting a golf ball and tee in the ground at a selected insertion depth. The device generally comprises a hollow shaft 10 having a knob 11 and an operating handle 14 at an upper end, a leg assembly 7 at the lower end, and a tee-setting mechanism 9 at the lower end for controlled insertion of a ball and tee in the ground. The tee and ball may be inserted with a single hand simply by gripping the operating handle 14, pushing downward to the preset desired depth, then twisting to lock the cage open for removal. This operates a spring-loaded push-rod internal to the shaft (not seen in FIG. 1) which upwardly-urges a cupped ball saddle 44 mounted at the lower distal end of the rod for firmly gripping the tee. In operation the cup saddle pushes the ball downward against the spring action. The cupped ball saddle 44 pushes the ball and tee downwardly through a ball cage assembly 12 (part of the tee-setting mechanism 9) attached to a lower end of the shaft 10. The ball cage assembly 12 confines the ball and grips the tee until properly inserted in the ground, at which point the ball cage assembly 12 opens to release the ball and tee.

Leg assembly 7 includes a tripod of legs that are pivotally attached above the ball cage assembly 12 and is automatically operable by a slide handle 48 of proper weight (just enough to overcome the friction) to ensure proper automatic unfolding by gravity to a spread position for steadying said ball cage 12 at a controlled height above the ground.

The stand-up tee setter 2 reduces the bending a golfer endures during a round of golf because it allows the golfer to implant a tee in the ground with ball atop without squatting or bending over the ball. While in the teeing area, a golfer need only deploy the leg assembly 7 and push and twist the operating handle 14 and the ball is ready to play. Moreover, the device 2 is so precise and consistent with its angle and insertion depth of the tee, it can help to improve one's score.

Figure 2:
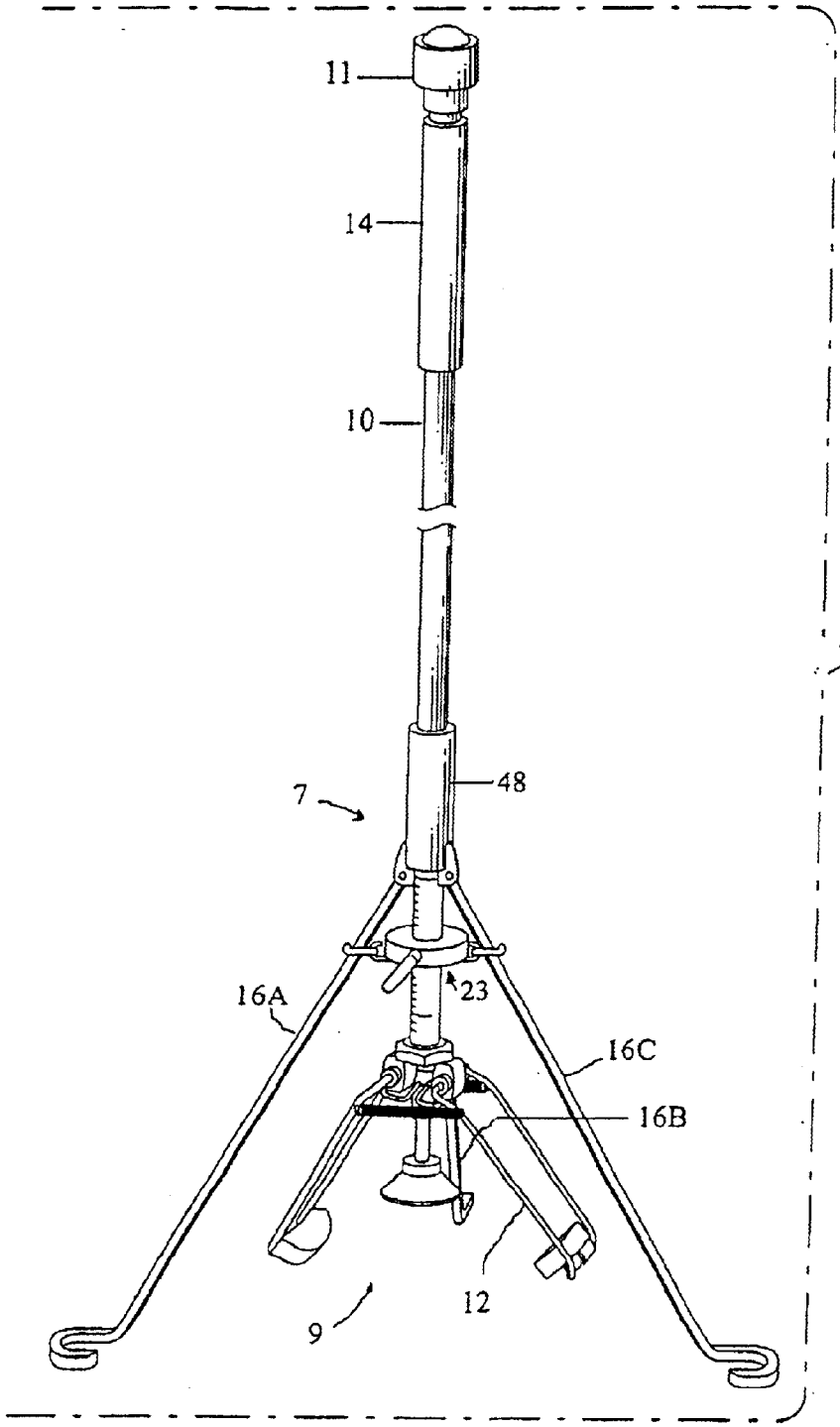
FIG. 2 is a front view of the stand-up tee setter 2 as in FIG. 1.

FIG. 2 is a front view of the stand-up tee setter 2 as in FIG. 1 inclusive of the elongate hollow shaft 10 with an articulating ball cage assembly 12 at the lower distal end. The operating handle 14 is slidably mounted on the upper end of shaft 10 just below the stationery knob 11 for ease of manual operation. Operating handle 14 is in operative engagement with the ball cage assembly 12 via internal control rod (not seen in FIG. 2) and, when urged downward within shaft 10, serves to insert the tee and open the ball cage assembly 12.

The trio legs 16A–16C of the leg assembly 7 include two lateral stand-up legs 16A & 16C which stabilize the tee setter 2, and a rear stand-up leg 16B which provides freestanding support, all legs straddling the ball cage assembly 12 and provide a working space. It should be apparent in light of FIGS. 1 and 2 that the tee setting device 2 is generally sized like a playing club or iron, and is easy to carry during a round of golf in a conventional golf bag. The ball cage 12 may be covered by a conventional club head cover. Thus, a golfer can carry the unobtrusive tee setter 2 together with golf clubs in the bag until he or she needs it.

To use the tee setter 2 to automatically implant a ball and tee in the ground, thereby avoiding squatting or bending over the ball, a golfer removes it from his/her bag and loads a ball and tee into the closed ball cage assembly 12, which initially holds the tee in place and constrains the ball there atop. With steady-legs 16A & 16C and stand up leg 16B pivoted down, the lower end of the tee setter 2 is planted on the ground. The operating handle 14 is maneuvered downward (as will be described) to implant the ball and tee, and then to open the ball cage assembly 12. The tee setter 2 is then easily swung free of the ball and tee leaving them standing in place and ready for teeing off. If desired, the golfer may leave the tee setter 2 off to the side of the tee in a self-supporting upright position (thereby avoiding the need to stoop to pick it up again). When it is time to move on, the legs 16A–16C are folded up and the tee setter is covered and returned to the golf bag for storage. The net result is that the golfer can complete an eighteen hole round without ever having to squat or bend over. Moreover, the design of the tee setter (as will be described) provides extreme accuracy and consistency in setting the height of the ball on the tee. The foregoing components will now be described in further detail.

As seen in FIG. 2, stationery knob 11 may be any knob adapted for attachment (by screw threads or the like) to shaft 10 and, if desired, may be used by the golfer to gain additional leverage in moving the operating handle 14. For added versatility, the stationery knob 11 docks with a conventional ball retriever of the resilient cup type to provide the added versatility of retrieving a dropped golf ball therein.

Figure 3:
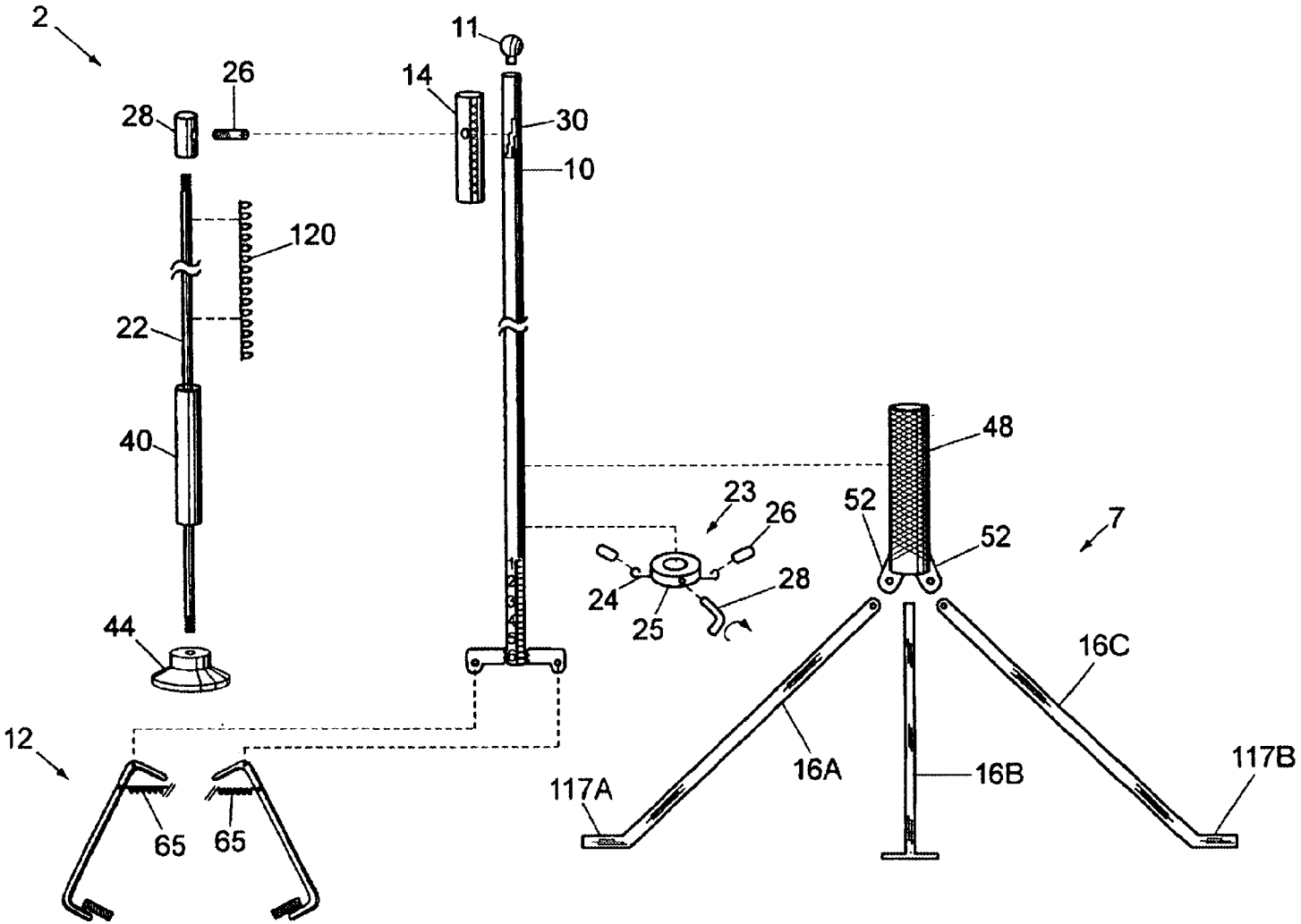
FIG. 3 is an exploded front view of the stand-up tee setter 2 as in FIGS. 1 and 2.

FIG. 3 is an exploded front view of the stand-up tee setter 2 as in FIGS. 1 and 2. The operating handle 14 is coupled via a guide screw 26 to an internal control rod 22, with cupped ball saddle 44 attached at the distal end of control rod 22. A raised portion 40 of the control rod 22 engages the ball cage assembly 12 when urged downward within shaft 10, and serves to open the ball cage assembly 12. More specifically, the operating handle 14 is formed as a sleeve that is slidably carried on the shaft 10 just below the stationery knob 11. Preferably, the exterior of handle 14 is textured or bears a layer of rubber or foam for a comfortable cushion grip. Guide screw 26 extends through the handle 14 and passes through a control notch 30 in shaft 10, and is anchored at the other end by threading into a guide bushing 28 that is attached by screw-thread to the top end of internal control rod 22. Control rod 22 extend downward through shaft 10 and is biased by a spring 120 (as will be described) for spring-loaded engagement with the ball cage assembly 12. It is important to note that the guide bushing 28 (which is a short cylindrical member) improves the sliding operation of handle 14 by filling any gap between the shaft 10 and control rod 22, and providing means for adjustably connecting the handle 14 to control rod 22.

As seen in FIG. 3, the aforementioned notch 30 in shaft 10 is formed as a control cut-out with various stop locations for guide screw 26, thereby indexing the vertical movement and twisting of handle 14. With this control notch 30, pushing the operating handle 14 downward to each stop, and then turning the handle clockwise, locks the ball cage assembly 12 open at that stop. Conversely, turning the handle 14 counterclockwise at each stop, and allowing the spring 120 to push the control rod 22 and handle 14 back up, closes the ball cage assembly 12 at the top of handle 14 movement. The golfer can either fold the tee setter 2 up and move on, or to insert another ball and start over. This feature is described in more detail with reference to FIG. 4.

FIG. 3 also illustrates the tension spring 120 that is carried on the control rod 22 and which is biased against a stop inside of shaft 10 to provide a rearward spring-bias against the control rod 22. This maintains an upward bias against handle 14, and by biasing the top surface of cupped ball saddle 44 against the cage control levers 60A provides additional clamping action of the cage. This holds the ball and tee securely in place until penetration has begun. One skilled in the art would recognize that a compression spring can be used to achieve the same purpose.

The cupped ball saddle 44 is attached to the end of the push rod prong 42. The cupped ball saddle 44 is a solid concave member that is shaped to seat a golf ball there beneath.

Figure 4:
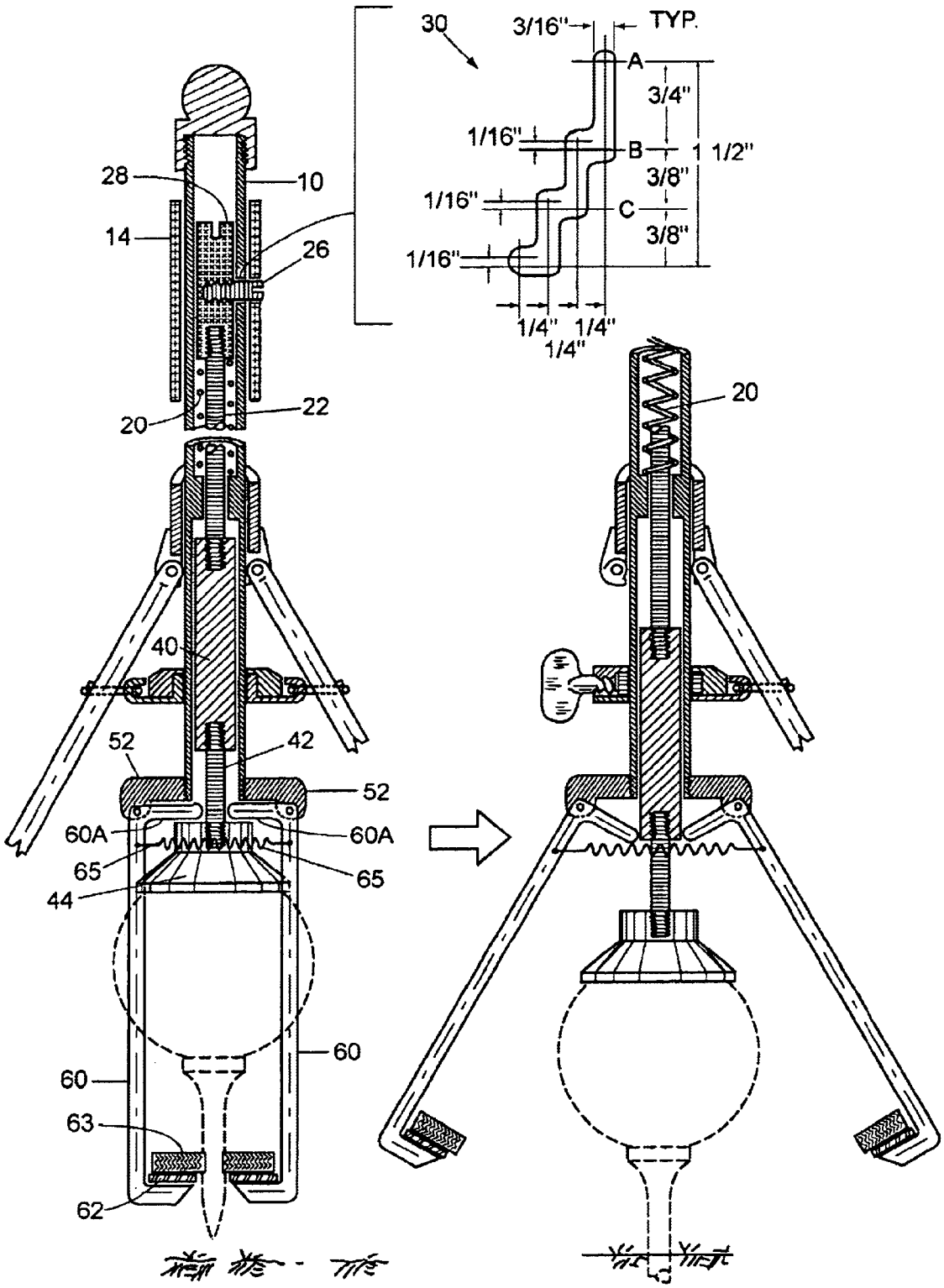
FIG. 4 is a front composite view of the stand-up tee setter 2 as in FIGS. 1–3.

FIG. 4 is a front composite view of the stand-up tee setter 2 as in FIGS. 1–3 illustrating the operation of the guide screw 26 as it travels downwardly along the path defined by control notch 30 (with exploded illustration of the notch 30 at right). As the guide screw 26 is urged downwardly along the path defined by control notch 30 it will encounter multiple stop positions (three exemplary stop-positions are shown), thereby providing precise control to the golfer. One skilled in the art will recognize that other control notch patterns and dimensions are possible, and all are considered within the scope and spirit of the present invention. The control notch 30 gives the golfer indexed control over the control rod 22 and allows incremental setting of the height of the tee (high, medium, low) when implanted in the ground. More specifically, the notch 30 begins at a start position A and moves directly downward to position B, which corresponds to initial penetration of the tee corresponding to a high-tee penetration of approximately 0.5" and the ball cage assembly 12 opening (as shown to the right).

Slight clockwise rotation locks the ball cage assembly 12 in an open position and allows continued advancement to position C, which moves the control rod 22 incrementally downward corresponding to a mid-tee penetration of approximately 1". By then rotating the handle 14 a few degrees and continuing advancement to position D, the control rod 22 achieves deeper penetration of the tee and a low-tee penetration of approximately 1.5". Another clockwise rotation of handle 14 locks the ball cage assembly 12 in an open position. The foregoing configuration gives the golfer precise control and the stop-positions provide tactile feedback. This ensures extreme accuracy in tee-insertion height and extreme consistency in setting the height of the ball on the tee. The illustrated control notch 30 is intended for right handed golfers. However, the control notch 30 can be reversed for left handers.

FIG. 4 also illustrates the automatic operation of the tee-setting mechanism 9, inclusive of ball cage assembly 12. The control rod 22 is threaded to (or is integrally formed with) a raised portion 40, which continues to a distal prong 42 that protrudes into the ball cage assembly 12. A cupped ball saddle 44 is attached to the end of the push control rod prong 42. The raised portion 40 acts as a bushing and rides within the hollow sleeve of shaft 10. The end of the shaft 10 is equipped with two protruding hinge supports 52 for pivotally mounting the opposing jaws 60 of ball cage assembly 12, which open and close around a ball and tee under the ball saddle 44. Each jaw 60 of the ball cage 60 is a formed two-prong wire member, with lever section 60A protruding latterally-inward toward the control rod prong 42. The jaws 60 are pivotally mounted to shaft 10 at the hinge supports 52, and extend vertically downward (together forming a four-member cage to retain a ball therein). In addition, each jaw of ball cage 60 extends downward and inward to an elastomeric tee grip 62 that grips a tee beneath the ball when the jaws of ball cage 60 are clamped together. Preferably, elastomeric inserts 63 are seated in the respective tee grips 62 to stabilize the tee. The jaws of the ball cage 60 pivot together to retain a ball in coaxial alignment atop a tee seated in the tee grip 62. The jaws of ball cage 60 are each biased closed by a tension spring 65 that straddles the two, or alternatively by torsion springs at the hinge points. However, downward pressure from the bushing 40 of control rod 22 will push the lever sections 60A downward, overcoming the bias of spring 65 and spring 20, opening the jaws 60 of ball cage assembly 12. This way, as the control rod 22 moves downward, the prong 42 and ball saddle 44 will move downward, and the bushing 40 will eventually bear against the lever sections 60A of jaws 60, thereby opening the jaws of the ball cage 60 immediately following and simultaneously with implanting the ball and tee. Thus, prior to teeing off the golfer will manually insert a tee in the closed tee grip 62 and a ball between the closed jaws 60 of the ball cage. The further the control rod 22 is pushed, the deeper the tee will be implanted (under control of the control notch 30) while bushing 40 maintains the ball jaws 60 open. As described above with reference to FIG. 4, the tee can be implanted (with ball atop) at one of a number of selectable heights relative to steady legs 16A and 16C and, once done, the jaws 60 can be locked in an open position for convenient removal of the tee setter 2 without disturbing the teed ball.

Figure 5:
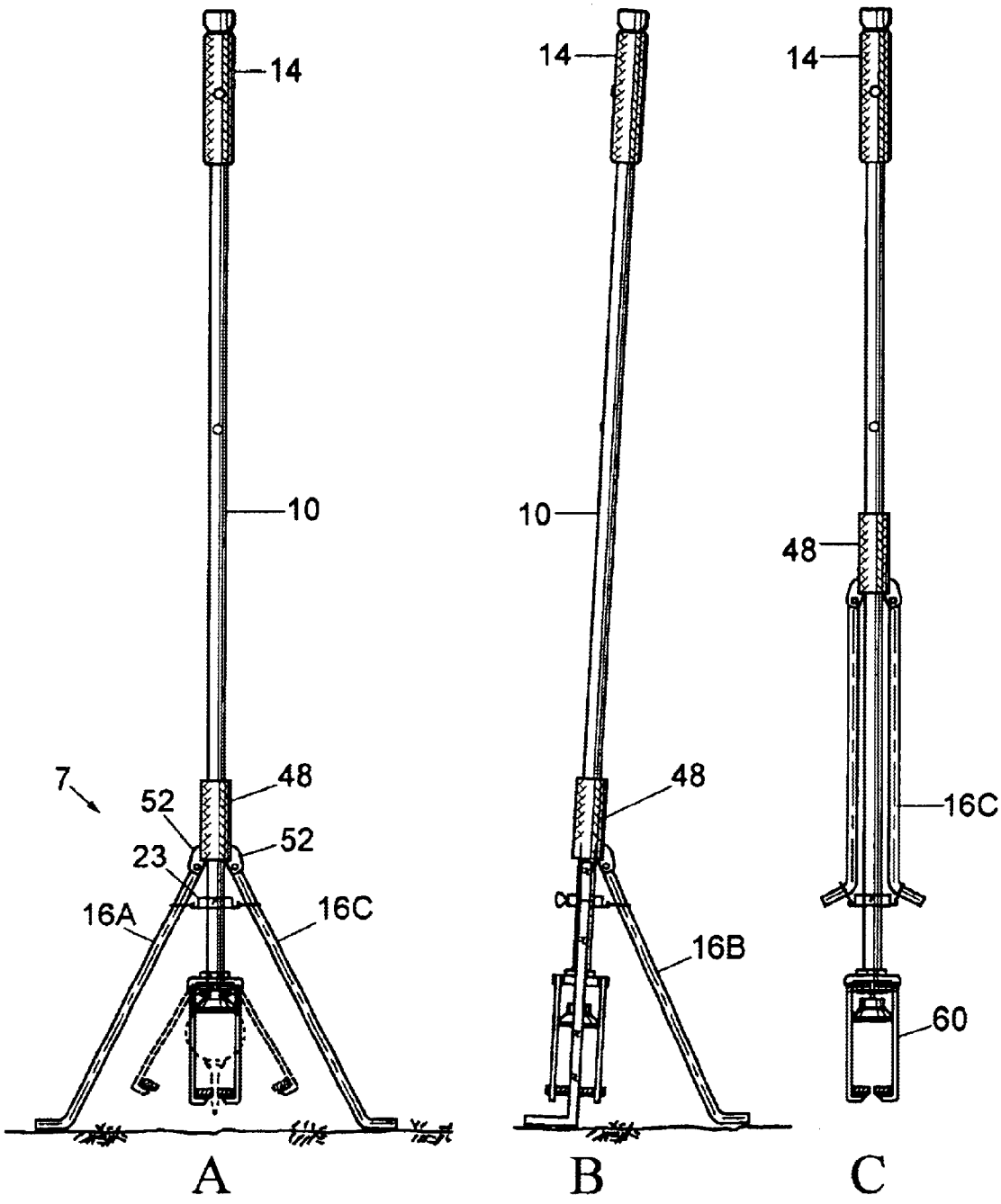
FIG. 5 is a composite view of the stand-up tee setter 2 as in FIGS. 1–4 illustrating the operation of the leg assembly 7.

FIG. 5 is a composite view of the stand-up tee setter 2 as in FIGS. 1–4 illustrating the operation of the leg assembly 7 (with front deployed view at position A, side deployed view at position B, and front with retracted legs 16A & 16B at position C). The trio legs 16A–16C of the leg assembly 7 include two lateral steady-up legs 16A & 16C which stabilize the tee setter 2, and a rear stand-up leg 16B which provides freestanding rear support all legs straddling the ball cage assembly 12 and providing a working space. All three legs 16A–16C are deployed together by the tubular slide-handle 48 which is slidably mounted on shaft 10. Slide handle 48 includes three lower flanges 53 to which the three respective legs 16A–16C are pivotally mounted. Thus, the legs 16A–16C move up and down shaft 10 in conjunction with slide handle 48. Steady legs 16A, 16C pivot outward from flanges 53 about the ball cage assembly 12 and straddle the ball cage assembly 12 to stabilize the tee setter 2, and the height of the tee is set is set relative to steady legs 16A and 16C. The stand-up legs 16B provides rear standing support behind the ball cage assembly 12. Each steady leg 16A, 16C as well as the stand-up leg 16B is an elongate strut with a horizontal bend at the end to form feet 117A–117C, thereby providing secure footing on the ground. A leg clamp block 23 is adjustably mounted along the lower portion of shaft 10 to fix the relative elevation of the ball cage assembly 12 with respect to the ground. This allows adjustment for the various conventional tee lengths as will be described.

Figure 6:
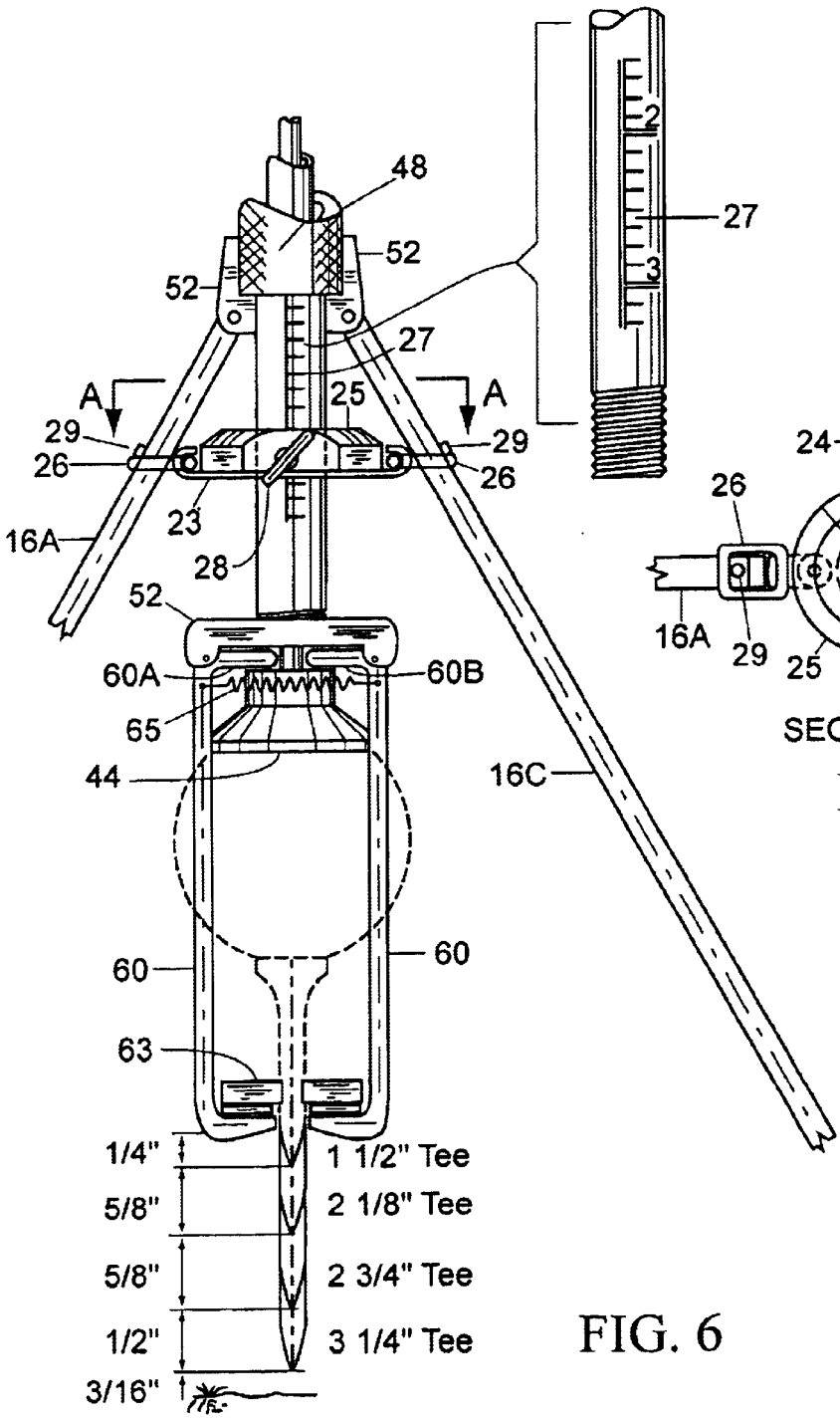
FIG. 6 is a front perspective view of the leg assembly 7 which illustrates the operation of the leg clamp block 23.
Figure 7:
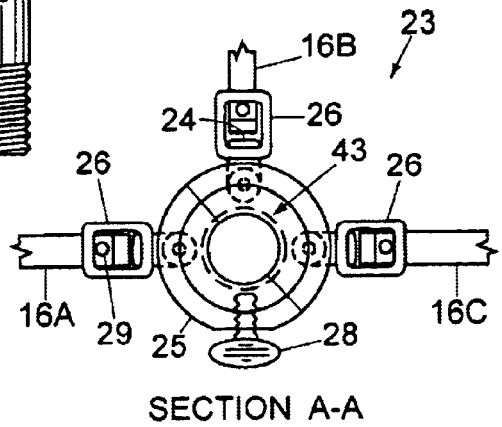
FIG. 7 is an enlarged top view of the leg clamp block 23.

FIG. 6 is a front perspective view of the leg assembly 7 which illustrates the operation of the leg clamp block 23, and FIG. 7 is an enlarged top view of the leg clamp block 23. With combined reference to FIGS. 5–7, the leg clamp block 23 further comprises an annular collar 25 around shaft 10 that may be locked in position along its length by a thumb screw 28. As seen in FIG. 7, the thumb screw engages a split clamp ring 43 which is seated in a counter bore in collar 25. The split clamp ring 43 prevents erosion of the shaft 10. An index 27 is ingrained along shaft 10 to demarcate the position of collar 25, which allows the golfer to set the tee setter 2 for a desired tee length. This feature accommodates all conventional tee lengths. A hook plate 24 is attached to the underside of collar 25, and hook plate 24 includes three hooks which loop out and around to the sides of collar 25.

Alternatively, the hook plate 24 and collar 25 may be an integrally-formed part. Three square eyelets 26 are pivotally inserted into the hooks of hook plate 24, and the legs 16A–16C are each inserted through a respective eyelet 26 (and are free to slide there through). The legs 16A–C may be deployed automatically with the help of gravity, as gravity will move the legs 16A–16C and handle 48 downward. As legs 16A–16C and slide handle 48 travel downward, the legs 16A–16C are flared outward by the fixed-position eyelets 26 and hooks of hook plate 24. Conversely, as the legs 16A–16C are pulled upward by slide handle 48 they are retracted inwardly by the fixed-position eyelets 26. In this manner, the golfer can selectively deploy all three legs 16A–16C automatically with gravity-assist, and can retract all three legs 16A–16C with one hand via slide handle 48. Each steady leg 16A, 16C may be formed with a fixed post 29 to fix the downward angle of the steady legs 16A, 16C. Thus, the eyelets 26 in leg clamp block 23 catch the posts 29 to limit the flare of the legs 16A, 16C. Inasmuch as the position of the leg clamp block 23 may be varied relative to index 27 along shaft 10, this allows the golfer to vary the downward extent of the ball cage assembly 12 to accommodate the full range of commercially available tee lengths.

In use, if the golfer knows the length of the tee to be used, they simply set and clamp the bottom of the leg clamp block 23 at the appropriate position on the index scale.

Referring back, FIG. 6 also illustrates the setting operation of the leg clamp block 23 for tee length. With enlarged view of the index 27 on shaft 10 to correlate the position of collar 25 with the desired tee length. For conventional tee lengths of 1½", 2⅛", 2¾" and 3¼", the position of the leg clamp block 23 is set incrementally lower along index 27 to elevate the relative position of the ball cage assembly 12 ball cage assembly relative to steady legs 16A, 16C. Thus, to determine proper tee length-with legs 16A–C folded and the leg clamp block 23 loose, the golfer moves the slide handle 48 up all the way. The golfer then places a tee against the bottom of the leg clamp block 23. The tee length is indicated by the mark at the tip of the tee, on the scale 27 which is engraved on the shaft tube 10. The golfer then moves the leg clamp block 23 to that mark on the scale 27 and clamps it in place by tightening the thumb-screw 7. No further adjustment is needed, until a different length tee is used.

The stand-up leg 16B is adapted to pivot outward behind the tee setter 2 (as shown at FIG. 5B) to provide a tripod (in conjunction with steady legs 16A, 16C) to allow the golfer to leave the tee is setter 2 in an upright standing position when not in use. This avoids the need to stoop to pick the device 2 up off the ground.

In operation of the above-described tee setter 2, a golfer will proceed through the following steps:

1. Press a golf ball against the side of the ball cage assembly 12 (through the ball cage jaws 60). The jaws 60 will open under slight pressure and the ball will easily snap into place.

2. Insert a tee in the tee grips 62 at the bottom of the ball cage assembly 12 in like manner. With fingers on the tee, press the tee and the ball together up firmly against the ball saddle 44.

3. Allow slide handle 48 to move downward by force of gravity to swing the steady legs 16A, 16C down and latch them in position by eyelets 26 engaging posts 29, the stand-up leg 16B will also deploy. The tee setter 2 is now ready for use.

4. Set the steady legs 16A, 16C firmly on the ground. Press down to set the steady legs 16A, 16C on the ground with the feet 117*a*, 117*b* firmly on the ground surface. This locates the device 2 at the proper elevation above the ground.

6. From the golfer's position above the setter 2 make sure the shaft 10 is practically vertical (otherwise, if the tee is not set practically vertical the ball will fall off).

7. Actuate the operating handle 14 by sliding down to the first stop, tuning slightly to navigate the control pattern in the cut-out notch 30 in shaft 10 which inserts the tee to the high-tee height and simultaneously opens the ball cage assembly 12. As previously described, this movement is controlled by the definite built-in stops A–D and cannot be forced past them.

8. While holding the setter 2 as nearly vertical as possible, slide the operating handle 14 straight down to the stop position, which is the mid-tee height. Turning the handle further clockwise continues to lock the ball cage open. Moving the handle 14 further down to the mid-tee position and further turning locks the ball cage assembly 12 in the mid-tee position. Finally, tilting the tee setter 2 about the steady legs and stand up legs 16A–C allows easy removal without disturbing the perfectly teed ball at either the low-, mid- or high-tee positions. As the operating handle 14 moves downward, the ball and the tee are pushed down together in the cage assembly 12. When the tee has penetrated the ground, continuing movement of the operating handle 14, while forcing the tee into final position, opens the ball cage jaws 60 to leave the ball perfectly teed after removing the setter 2 from the ball. The golfer then moves the operating handle 14 upward by a series of short counter-clockwise turns.

The foregoing describes the simplest teeing operation, which allows setting of a tee to only one tee height (in the illustrated embodiment, to the "High Tee" alterative). The additional alternatives, i.e. "Mid Tee", and "Low Tee" heights are also attainable in the manner described previously.

In this manner the tee setting device 2 allows golfers to automatically set the ball and tee in the ground, thereby avoiding squatting or bending over the ball. The device 2 is extremely accurate and consistent in setting the height of the ball on the tee. Moreover, the tee setting device 2 is similar in size to that of a playing club or iron, and can be easily manipulated and stowed in the golf bag. Furthermore, the device 2 has few moving parts, is capable of easy operation, and is most durable and well-suited for long-term use.

Having now fully set forth the preferred embodiments and certain modifications of the concept underlying the present invention, it is to be understood, therefore, that the invention may be practiced otherwise than as specifically set forth in the appended claims.

What is claimed is:

1. A tee setting device for setting a golf ball and tee in the ground, comprising:

a hollow shaft having an indexed tee height control cut-out at an upper end thereof and a sliding operating handle slidably disposed on said hollow shaft about said tee height control cut-out;

a leg assembly at a lower portion of said shaft for steadying said ball cage at variable controlled heights above the ground;

a control rod internal to said shaft, said control rod having a ball saddle at a lower end for urging a golf ball and tee downwardly, said control rod being fixedly connected to said operating handle by a guide screw coupled there between and that passes through the tee height control cut-out in said shaft for slidably traversing said tee height control cut-out so that downward urging of the operating handle is guided by the guide screw engagement with said tee height control cut-out to move said ball saddle downward an indexed amount;

a ball cage assembly at the lower end of said shaft for constraining said ball and tee during downward movement of said control rod and for releasing said ball and tee once initially implanted;

whereby said tee setting device allows a golfer to implant a tee in the ground with ball atop without squatting or bending over the ball.

2. The tee setting device according to claim 1, wherein said leg assembly further comprises a pair of steady legs that straddle said ball cage assembly.

3. The tee setting device according to claim 2, wherein said leg assembly further comprises a stand up leg that forms a tripod with said pair of steady legs.

4. A tee setting device for setting a golf ball and tee in the ground, comprising:

a hollow shaft having a sliding operating handle at an upper end thereof;

a leg assembly comprising a pair of steady leas that straddle said ball cage assembly at a lower portion of said shaft for steadying said ball cage at variable controlled heights above the ground;

a slide handle mounted on said hollow shaft, said pair of steady legs being coupled to said slide handle for controlled deployment or retraction thereof;

a control rod internal to said shaft, said control rod having a ball saddle at a lower end for urging a golf ball and tee downwardly, said control rod being coupled to said operating handle so that downward urging of the operating handle moves said ball saddle downward;

a ball cage assembly at the lower end of said shaft for constraining said ball and tee during downward movement of said control rod and for releasing said ball and tee once initially implanted;

whereby said tee setting device allows a golfer to implant a tee in the ground with ball atop without squatting or bending over the ball.

5. The tee setting device according to claim 3, wherein said pair of steady legs and said stand-up leg are coupled to a slide handle for controlled deployment or retraction thereof.

6. The tee setting device according to claim 5, wherein said pair of steady legs an said stand-up leg are slidably inserted through a leg clamp block adjustably attached to said shaft for controlled deployment or retraction thereof.

7. The tee setting device according to claim 6, wherein said leg clamp block is adjustably attached to said shaft by a thumb screw engaging a protective split ring clamp that bears against said shaft.

8. The tee setting device according to claim 1, wherein said ball cage assembly further comprises two opposing jaws for constraining said ball and gripping said tee during downward movement of said control rod and for releasing said ball and tee once initially implanted.

9. The tee setting device according to claim 2, wherein said pair of steady legs and slide handle deploy automatically via gravity, and said operating handle is operable by one hand for single-handed setting of a golf ball and tee in the ground.

10. A tee setting device for setting a golf ball and tee in the ground, comprising:

a hollow shaft having a patterned control tee height control cut-out at an upper end;

a sliding operating handle carried about the shaft;

a control rod internal to and extending downward through said shaft;

a guide screw fixedly attached between said control rod and operating handle and protruding through said tee height control cut-out;

a ball cage assembly attached to a lower end of said shaft and further comprising opposing ball cage jaws for containing a golf ball and gripping a tee there below, said ball cage jaws being operatively engaged with said control rod and selectively openable by sliding operation of said operating handle; and at least two steady legs pivotally and adjustably attached above said ball cage assembly and unfoldable to a spread position for steadying said ball cage at variable heights above the ground and to accommodate a variety of different tee lengths;

whereby said apparatus allows a golfer to implant the tee in the ground with ball thereon without squatting or bending over the ball.

11. The tee setting device according to claim 10, wherein said tee height control cut-out in said shaft defines three positions corresponding to high-tee-insertion, mid-tee-insertion, and low-tee insertion.

12. The tee setting device according to claim 10, wherein said at least two steady legs straddle said ball cage assembly.

13. The tee setting device according to claim 10, further comprising a stand up leg that forms a tripod with said pair of steady legs.

14. The tee setting device according to claim 10, wherein said pair of steady legs are coupled to a slide handle for controlled deployment or retraction thereof.

15. The tee setting device according to claim 11, wherein said pair of steady legs and said stand-up leg are coupled to a slide handle for controlled deployment or retraction thereof.

16. The tee setting device according to claim 15, wherein said pair of steady legs and said stand-up leg are slidably inserted through movable eyelets on a leg clamp block adjustably attached to said shaft for controlled deployment or retraction thereof.

17. The tee setting device according to claim 16, wherein said leg clamp block is adjustably attached to said shaft by a thumb screw and split ring clamp.

18. The tee setting device according to claim 10, wherein said ball cage jaws constrain said ball and grip said tee during downward movement of said control rod and releasing said ball and tee once initially implanted.

* * * * *